United States Patent [19]

Klaus et al.

[11] 4,316,527

[45] Feb. 23, 1982

[54] APPARATUS FOR THE PARKING OF VEHICLES ON MOBILE PLATFORMS

[76] Inventors: Kaspar Klaus, Dr.-Berndl-Str. 5, D-8940 Memmingen; Franz Treppesch, Herbisrieder-Str. 2a, D-8944 Grönenbach, both of Fed. Rep. of Germany

[21] Appl. No.: 76,790

[22] Filed: Sep. 18, 1979

[30] Foreign Application Priority Data

Sep. 30, 1978 [DE] Fed. Rep. of Germany ..... 2842700
Aug. 4, 1979 [DE] Fed. Rep. of Germany ..... 2931713

[51] Int. Cl.[3] ..... B60S 13/00
[52] U.S. Cl. ..... 187/8.71; 414/229
[58] Field of Search ..... 187/8.41, 8.43, 8.71; 414/229, 228, 233, 258, 249

[56] References Cited

U.S. PATENT DOCUMENTS 3,861,540 1/1975 Lendi et al. ..... 414/229

FOREIGN PATENT DOCUMENTS 112819 1/1969 Denmark ..... 187/8.71
1965142 12/1969 Fed. Rep. of Germany ..... 414/229
2008915 11/1971 Fed. Rep. of Germany ..... 414/229

*Primary Examiner*—Robert J. Spar
*Assistant Examiner*—Kenneth Noland
*Attorney, Agent, or Firm*—Holman & Stern

[57] ABSTRACT

An apparatus for making optimum use of parking space and providing unobtrusive stowage of vehicles has a plurality of superimposed parking platforms which can be hoisted and lowered for access from a single entry site by a mechanism including a parallelogram linkage. Provision can be made for tilting the platforms to assist access and conserve compactness.

9 Claims, 5 Drawing Figures

FIG. 1
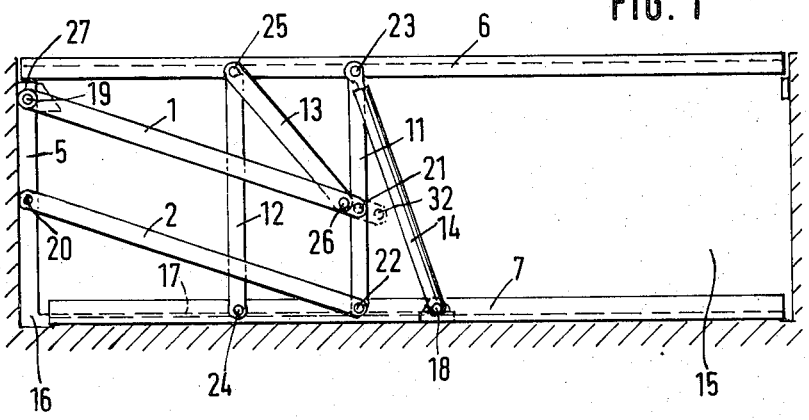
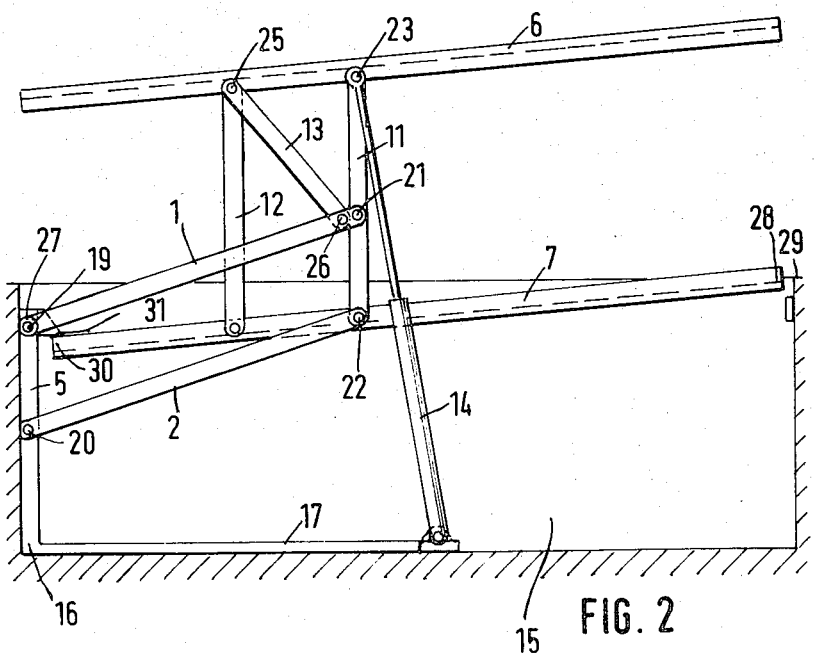
FIG. 2

FIG. 4
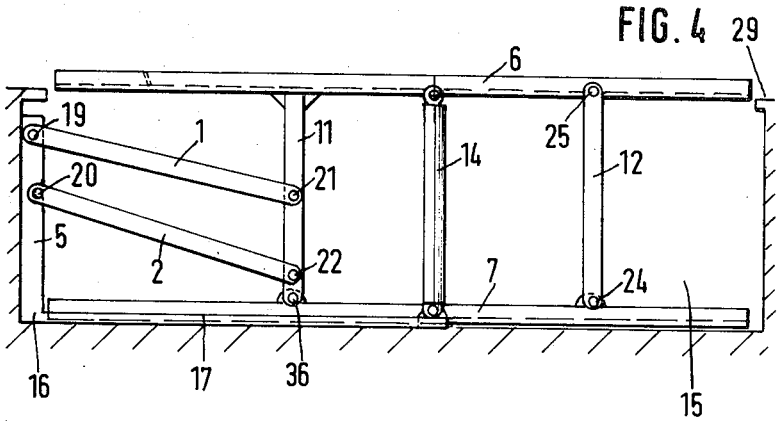
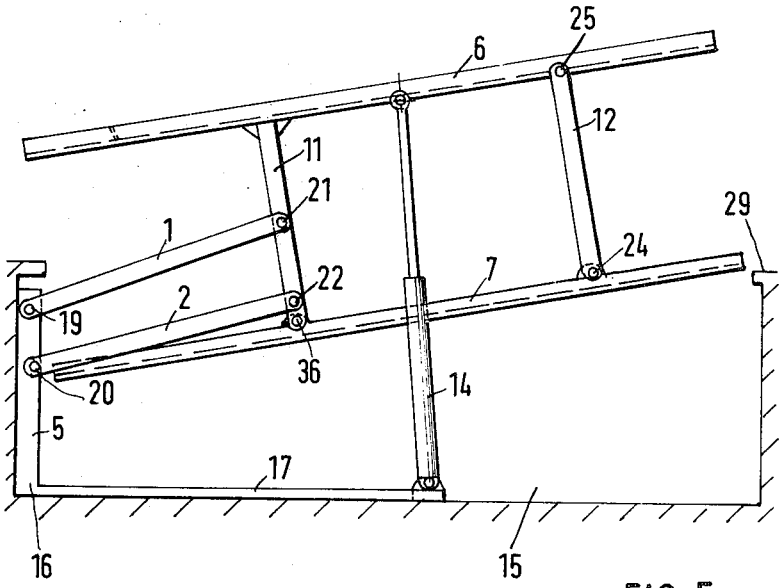
FIG. 5

APPARATUS FOR THE PARKING OF VEHICLES ON MOBILE PLATFORMS

BACKGROUND OF THE INVENTION

1. Field of the Invention

The invention relates to an apparatus for the parking of vehicles of the kind comprising at least two platforms arranged one above another and movable collectively in a substantially vertical direction to bring any selected platform into communication with a common vehicle-entry area.

2. Description of the Prior Art

The prior art discloses apparatus of this kind which are so constructed that one or more platforms with vehicles disposed thereon can be lowered into a pit beneath the point at which vehicles approach the apparatus. The uppermost platform can constitute a parking space for a vehicle when the apparatus is retracted. It is also possible to devise the apparatus in such a way that the uppermost platform, which for example may be so made as to allow for travel thereacross, can serve as a trackway for other purposes.

One known apparatus of this kind has a rail at one or both sides of the platforms with carriages movable thereon and carrying the platforms. The carriages can be moved vertically by means of a power unit. Again, means are known for tilting the platforms relatively to the carriages and the rails, with the advantage that the "lift" can be kept somewhat less than the depth of the pit. It also enables one of the ends, namely the lifted end, of a platform to be brought into communication with the entry area.

The distribution of the load to be carried by the platform is not known in advance and the rails themselves have a substantial weight, so that care is necessary in designing the rails and the carriages and the general equipment of the apparatus. The mounting in the pit normally requires a hoist mechanism and is consequently expensive and time-consuming.

A further difficulty with this known construction is that it is only with trouble that one can get all the parts into the pit in the retracted condition and leave no constructional part standing proud. This is required if for example the upper platform is to be used as a throughway. This difficulty usually arises because the depth of the pit is approximately the same as the height of lift by the apparatus so that in the case of a rail length of the order of the depth of the pit there is not adequate guidance left between the rail and the carriage. It is necessary therefore either to work with a multipartite telescopic arrangement or to provide additional depth in the pit to provide for safe mutual guidance.

SUMMARY OF THE INVENTION

It is an aim of the present invention to improve an apparatus for parking of vehicles on platforms of the kind set forth above by substantially simplifying the manufacture and assembly. A further object of the present invention is to devise an apparatus which can cater for varying movements or dimensions using substantially the same constructional parts, so that different types of parking apparatus can very readily be made available.

To meet these aims the invention, proposes, in an apparatus of the type set forth above, the provision of operating equipment which includes at least one parallelogram linkage which extends substantially horizontally when collapsed, is pivotally mounted at one end on a fixed support forming part of said linkage, and is pivotally connected at its other end to strut means connecting said platforms.

It has been found that using a parallelogram linkage in this context, various practical problems are dealt with in a surprisingly simple way. Admittedly the parallelogram linkage does not provide for an exact vertical movement of the platforms, but movement on a quasi-circular trajectory. Since however it is possible to provide links of adequate length in the linkage this situation does not present a disadvantage. It is easy to bring each of the platforms into exact register with the vehicle entry. Since the links of the linkage are substantially subjected only to tensile and compression stresses their construction is simple. All that is required is that the pivot joints of the linkage shall be of adequate construction and strength.

The use of a parallelogram linkage per se determines the height of lift and caters for safe thrust and guidance even in an extensively projected condition. Moreover all the parts can be housed in the pit and not stand proud of the ground when the platforms are lowered.

The individual platforms can be connected in various ways in implementing the invention. It is preferred however to use a pair of vertical struts for this purpose with the parallelogram linkage engaging at least one of the struts. In a further feature of the invention the pair of struts may itself form part of a second parallelogram linkage acted on by the first such linkage to cater for tilting of the platform.

To provide such tilting movement known types of structures can however be incorporated, and, for example all the platforms are first tilted and then these tilted platforms lifted together. The reverse procedure is possible, namely first lifting the platforms in parallel horizontal status and at the end of the lift with a tilting motion. Again, a combined lift and superimposed tilting is possible.

Such motions can be brought about by various means such as pull coupling members between the platforms and linkage(s) and so on. Thus in a preferred embodiment of the invention a coupling link operated by the first parallelogram linkage is provided for producing the tiling of the platforms. Using a coupling link operated by the first parallelogram linkage a multiplicity of different tilting movements of the platforms can be achieved. One or other of the ends of the platform for example can be tilted, and the maximum angle of tilt can be adapted to prevailing conditions and requirements by a simple change in the coupling link or the pivot joints thereof.

It is of advantage if the fixed support to which the first parallelogram linkage is connected is disposed in the vicinity of one of the ends of the platforms. The other end of the first parallelogram linkage may, in a two platform assembly, advantageously be disposed somewhere in the center of the platform assembly, but in the case of a three platform assembly may best be in the area of the outer ends of the platforms.

In carrying out the invention the links of the parallelogram may be only approximately parallel to one another, for example the spacing of the pivot joints of the links at the ends nearest the entry ends of the platforms may be made somewhat larger than the spacing between the pivot joints at the other ends of the platforms. It is agreed that this is not true parallelism in the strictly geometrical sense but in this specification we shall use the word parallelogram to include this variant since it falls within the spirit and overall effect of the invention.

Where the links are only approximately parallel, the two platforms are not moved entirely parallel during their upward movement but subject to a slight turning movement they may both be entirely horizontal when lowered but in their raised condition may be tilted so that for example the lower platform represents a downward gradient for a vehicle running on to it. The advantage of some deviation from parallelism between the two links is that all the additional elements described above to bring about a tilting movement in addition to the lifting are dispensed with.

In a further form of the invention, provision is made for the two platforms to be connected together in substantially rigid fashion. It is part of the prior art to connect rigidly together two platforms of an apparatus for parking vehicles and to lift and lower them together. The invention however provides a substantial constructional simplification and increase in stability in a construction of this kind.

The pair of links which form the parallelogram linkage, or the main parallelogram linkage, in the system of this invention is preferably mounted on a fixed support arranged at the end of the apparatus away from the vehicle entry zone. It is to be noted however that the support could be located at the run-in end, but the mounting at the other end is preferred because it allows for a shorter length of link. This is because the movement of the platforms at this end of the platforms is less than at the entry end.

Finally a particularly advantageous form of the invention includes a connection strut between the platforms which is upright in the lowered condition of the platforms, and the parallelogram linkage comprise two spaced links of equal length pivotally connected at their ends to the said strut at vertically spaced points, the intervening length of the strut, and the part of the fixed support between the pivot joints at which the links are connected thereto.

BRIEF DESCRIPTION OF THE DRAWINGS

Some examples of embodiment of the present invention are diagrammatically illustrated in the accompanying drawings in which:

FIG. 1 is a side view of an apparatus according to the invention with the platforms shown in the lowered condition, FIG. 2 is an illustration of the apparatus of FIG. 1 with the platforms raised, FIG. 4 is a side view of yet another embodiment of the apparatus according to the invention with the platforms lowered, and FIG. 5 is a representation of the apparatus shown in FIG. 4 but with the platforms shown raised.

DESCRIPTION OF THE PREFERRED EMBODIMENTS

Figure 3:
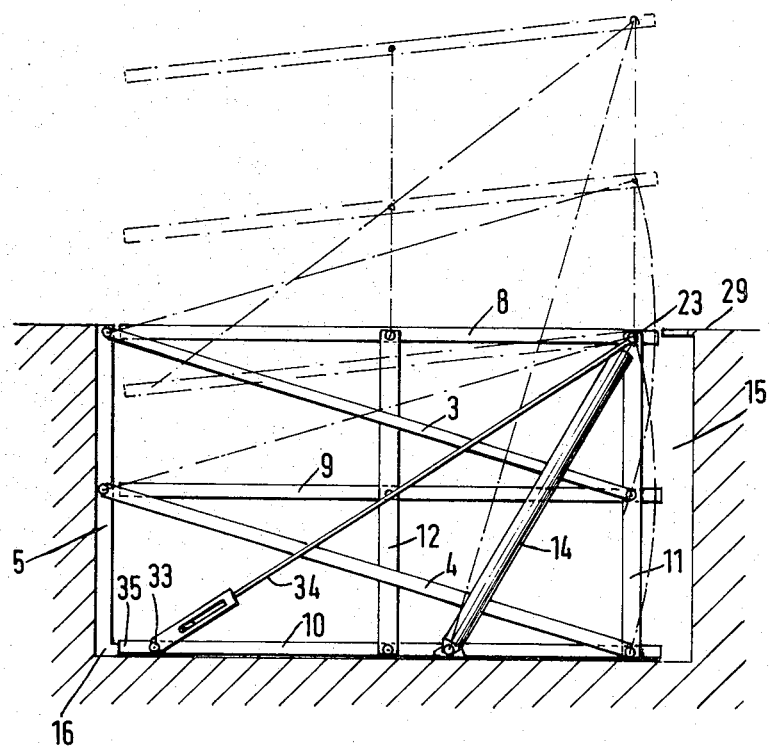
FIG. 3 illustrates a further form of the invention with the platforms lowered.

In the embodiment illustrated in FIGS. 1 and 2 of the drawings the apparatus comprises an upper platform 6 and a lower platform 7, these platforms and the associated equipment being so constructed and arranged that when lowered (FIG. 1) they are wholly received in a pit 15. Arranged in this pit is a basic support frame 16 comprising a horizontal part 17 and an upstanding part or vertical member 5 which supports links 1 and 2 of a first parallelogram linkage at pivot joints designated 19 and 20. The free ends of the links 1 and 2 are connected through pivot joints 21 and 22 to a strut 11 forming one limb of the parallelogram and connected to the platform 6 at a pivot joint 23 and with the platform 7 through pivot joint 22. Platform 7 is pivotally connected to link 2 at the joint 22.

Parallel to strut 11 is a strut 12 connected to platforms 6 and 7 at pivot joints 25 and 24, respectively, and a coupling member 13 extends between pivot 25 and a pivot joint 26 on link 1. A hydraulic piston-cylinder unit 14 for operating the linkage controlling the platforms 6 and 7 is pivotally connected at 23 to the upper platform 6 and is supported on a plummer block on the part 17 of the base frame.

It is to be noted that the arrangement of linkages, coupling struts and piston-cylinder unit described above will usually be duplicated at the two sides of the platforms 6 and 7. In this event to achieve balanced movement a stationary constructional component will preferably be provided between the pivots 19 of the link 1 at the two sides, for example a tube 27 which forms a yoke for the links 1 at the two sides. Uniform operation can, however, be adduced by other appropriate means, for example by hydraulically coupling the two cylinders 14 at the two sides of the platforms.

Starting from the position illustrated in FIG. 1 when the unit 14 is operated the apparatus moves into the position illustrated in FIG. 2. During the upward movement of the first parallelogram linkage comprising the links 1 and 2 the coupling member 13 is operated and this in turn moves the second parallelogram linkage comprising the links 11 and 12. This means that in the raised condition the platforms 6 and 7 become inclined to the horizontal and the end 28 of the lower platform 7 is brought so as to adjoin the part 29 of the ground level adjoining the edge of the pit 15 which may be regarded as the entry of the parking area. To consolidate the "entry-available" position the opposite end 30 of the lowered platform 7 bears on an abutment 31 forming part of the support means 5. It will be noted that the "lift" of the two platforms is not the same as the depth of the pit.

The construction illustrated can be varied in a number of ways. If a somewhat longer coupling member 13 is used and this coupled between the pivot joints 25 and 21, there is no tilting movement during the upward motion. In another variant the coupling member 13 can be connected through a pivot joint 32, to an extension of the link 1, as indicated in dot and dash lines in FIG. 1. The platforms 6 and 7 will then have an oppositely-orientated inclination when raised. If required the inclination of the platforms can be achieved by other means, as for example illustrated in FIG. 3. This figure shows an embodiment of the invention having three superimposed platforms 8, 9 and 10. The links 3 and 4 form part of a parallelogram linkage and it is clear that when the piston-cylinder unit 14 is operated platforms can be lifted in such a way that either the platform 9 or the platform 10 can be brought selectively opposite the entry 29. The platforms 8, 9 and 10 are connected by two struts 11 and 12 comparable with those described above, and these platforms can be tilted through the action of a pull connection 34 extending between the point 33 on the lower platform 10 and the pivot connection 23 between the strut 11 and the upper platform 8. In the lowered condition the pull connection 34 is partly telescoped. When lifting takes place the end 35 of the lower platform 10 will first rest on the corresponding support until the maximum inclination of the platforms and the maximum length of pull connection is achieved. The member 34 will then swing up the inclined platforms. The construction arrangement of the pull connection illustrated is only to be regarded as exemplary and can readily be superseded by other constructional means.

The invention can be reproduced in various ways other than that illustrated. Thus the support 5 which in the drawing is shown in the area of one end of the platforms can, if required, be provided alongside the platforms. Whilst in the two-platform construction the length of the links of the first parallelogram linkage is approximately half the length of a platform, it is recommended that in a construction using three platforms links of a length approximately equal to that of a platform be provided. Constructions can also be implemented in which the platforms are given different inclinations, for example by making the links 1 and 2 nonparallel with one another. This may be of advantage where special considerations of space and vehicle standing apply.

In the embodiment of FIGS. 4 and 5, which returns to a two-platform system, the strut 11 is firmly secured to the platform 6 whilst connected to the platform 7 by means of a pivot joint 36 which alone has the function of catering for deformations under load and/or facilitating assembly. Further a strut 12 extends between the two platforms 6 and 7 and again can be connected to the platforms through pivot joints 25 and 24 to have a similar function to that of the pivot joint 36. A hydraulic piston-cylinder unit 40 also extends between the horizontal part 17 of the base frame and platform 6.

The pivot joints 21 and 22 of the parallelogram linkage on the strut 11 are arranged exactly one above the other and the links 1 and 2 are of equal length. The distance between the pivot joints 19 and 20 on part 5 of the base frame support in FIG. 4 is, however, smaller than the distance between the pivot joints 21 and 22. It is clear that under these circumstances the pivot joints 19 and 20 will no longer be exactly vertically one above the other and the pivot joint 19 will be at a greater horizontal distance from the entry 29 than the pivot joint 20. The deviation from parallelism of the links 1 and 2 produces in the extension of the links 1 and 2 an instantaneous center of revolution and, when the cylinder 14 is operated, the platforms 6 and 7 connected thereto in addition to the upward motion also perform a turning movement around this center of revolution so that, in the raised condition of FIG. 5 the two platforms 6 and 7 are at an inclination. This does not however interfere in any way with the movement of a vehicle on to the platform 7, but has the considerable advantage that the overall upward movement is less than the depth of the pit 15 whereby, inter alia, the space height required is reduced.

The invention can also be implemented with the length of the links 1 and 2 slightly different from one another, in which event the deviations from parallelism can be even less.

We claim:

1. In apparatus for the multitier packing of vehicles, comprising at least two vehicle-receiver platforms, equipment to mount the platforms in superposed relationship and to raise the platforms simultaneously in a substantially vertical direction in this condition to bring a selected platform into communication with a stationary vehicle-access area, the improvement in which said equipment comprises at least one parallelogram linkage arranged in a superposed spaced relation and which extends substantially horizontally when collapsed, said at least one parallelogram linkage being attached at one end to a fixed substantially vertical support forming part of said linkage by means solely for pivotal mounting, said pivotal mounting means being vertically disposed and, said at least one parallelogram linkage being attached at its other end to strut means connecting said platforms by pivotal connecting means, said pivotal connecting means being vertically disposed.

2. Apparatus according to claim 1, in which the strut means comprise two parallel, substantially vertical struts, the said parallelogram linkage piviotally engaging one of said struts at vertically-spaced locations, whereby the part of the strut between these locations forms a limb of the aforesaid parallelogram linkage.

3. Apparatus according to claim 2, in which said struts are each pivotally connected to said platforms and form with the interim parts of these platforms a second parallelogram linkage, and means are provided to deform said second parallelogram linkage and thereby induce tilting of said platforms.

4. Apparatus according to claim 3, in which said deforming means comprises a coupling member pivotally connected between a movable member of said first-mentioned parallelogram linkage and said second parallelogram linkage.

5. Apparatus according to claim 1, in which said fixed support is disposed adjacent one end of said platforms when the latter are retracted.

6. Apparatus according to claim 1 comprising three superposed platforms, in which the said strut means is provided at a part of the platform assembly remote from said fixed support, wherefore the parallelogram linkage extends over at least a substantial part of the length dimension of said platforms.

7. Apparatus according to claim 1 in which said platform mounting and raising equipment is provided at both sides of the apparatus, and the parallelogram linkages of the equipment on each side are rigidly interconnected.

8. Apparatus according to claim 1, in which the distance between the pivotal connections of said linkage to said strut means is greater than the distance between the pivot connection of said linkage to the fixed support.

9. Apparatus according to claim 1, including a connection strut between the platforms which is upright in the lowered condition of the platforms, and the parallelogram linkage comprise two spaced links of equal length pivotally connected at their ends to the said strut at vertically spaced points, the intervening length of the strut and the part of the fixed support between the pivot joints at which the links are connected thereto.

* * * * *